US007401488B2

(12) United States Patent
Baba

(10) Patent No.: US 7,401,488 B2
(45) Date of Patent: Jul. 22, 2008

(54) DIE CUSHION APPARATUS

(75) Inventor: Kiyokazu Baba, Ishikawa (JP)

(73) Assignees: Komatsu Ltd., Tokyo (JP); KOMATSU Industries Corp., Tokyo (JP)

( * ) Notice: Subject to any disclaimer, the term of this patent is extended or adjusted under 35 U.S.C. 154(b) by 0 days.

(21) Appl. No.: 11/141,056

(22) Filed: Jun. 1, 2005

(65) Prior Publication Data

US 2005/0262915 A1 Dec. 1, 2005

(30) Foreign Application Priority Data

Jun. 1, 2004 (JP) ..... 2004-163198
May 26, 2005 (JP) ..... 2005-154028

(51) Int. Cl.
*B21D 22/00* (2006.01)
*B21J 9/18* (2006.01)

(52) U.S. Cl. ..... 72/351; 72/453.13

(58) Field of Classification Search ..... 72/350, 72/351, 453.12, 453.13, 441, 446, 454; 267/119, 267/130; 100/269.18, 269.2
See application file for complete search history.

(56) References Cited

U.S. PATENT DOCUMENTS 3,914,978 A * 10/1975 Sekanina et al. ..... 72/466.7
4,033,252 A * 7/1977 Baker ..... 100/99
5,299,444 A * 4/1994 Kirii et al. ..... 72/453.13
5,435,166 A * 7/1995 Sunada ..... 72/351
6,085,520 A * 7/2000 Kohno ..... 60/414

* cited by examiner

*Primary Examiner*—Derris H. Banks
*Assistant Examiner*—Teresa Bonk
(74) *Attorney, Agent, or Firm*—Posz Law Group, PLC

(57) ABSTRACT

A cylinder is formed in the lower portion of a cushion pad, and a piston coupled to an upper end of a rod is slidably contained in the cylinder. The rod is coupled to a rotary shaft of a servomotor. An oil pressure chamber is formed of an inner wall surface of the cylinder and a wall surface of the piston. The axial center of the oil pressure chamber is identical with the axial center of the rod. The pressure oil for alleviating an impact is filled in the oil pressure chamber. The pressure oil filled in the oil pressure chamber absorbs a force operating instantaneously at the cushion pad. According to this structure, the impact generated in a press machine can be alleviated.

5 Claims, 11 Drawing Sheets

DIE CUSHION APPARATUS

BACKGROUND OF THE INVENTION

1. Field of the Invention

The present invention relates to a die cushion apparatus which drives to raise or lower a cushion pad while applying an upward energizing force, and more particularly to a die cushion apparatus which alleviates an impact generated in a press machine.

2. Description of the Related Art

A die cushion apparatus (hereinafter merely referred to as a "die cushion") for crease pressing in a drawing work is provided in a press machine. A conventional die cushion generates a cushion pressure while driving to raise or lower a cushion pad by using a hydraulic pressure or an air pressure. In order to prevent a work from being damaged or strained by raising drawing workability of the die cushion, it is necessary to control the cushion pressure of the die cushion in high accuracy, and particularly, it is necessary to control the cushion pressure at the time of lowering operation of the cushion pad in high accuracy.

The die cushion using only the air pressure cannot control the cushion pressure in high accuracy at the time of operating the cushion pad. The die cushion using the hydraulic pressure can control the cushion pressure in high accuracy at the time of operating the cushion pad under the control of a hydraulic pressure. However, a structure of a hydraulic apparatus is complicated, and there is a difficult point of needing severe maintenance and management. Therefore, recently, a die cushion having an electric servomotor which has a simple structure and which does not need severe maintenance and management is noted.

When a slide lowers so that an upper die is brought into contact with a work in the case of press working, there arises a state that the slide of large weight collides with the cushion pad. Since a large load is operated instantaneously at the cushion pad, a large impact occurs in the press machine.

FIG. 11 is a view showing the relationship between a load operated at the cushion pad and a time in a conventional apparatus. Here, a load change after the upper die is contacted with the work is shown. According to FIG. 11, it is understood that, when the upper die is contacted with the work, an overshoot further exceeding a normal value is generated.

In order to alleviate such an impact, the cushion pad is lowered synchronously with the lowering operation of the slide to lower the cushion pad so that a relative speed of the upper die side (slide) to the work side (cushion pad) is decelerated in a control aspect, so called a preliminary acceleration is performed.

If a large impact continuously arises, there occurs a problem that a wearing speed of a mold is accelerated to cause a cost to rise. If the impact is large, an impact sound generated in this case increases, and a problem of a noise also occurs. In order to avoid these problems, it is desired to reduce the impact as much as possible. Therefore, a devise is desired not only in a field of the control but also in a structure of the die cushion.

The present invention is made in view of such a fact, and provides a die cushion having a structure which can alleviate an impact generated in a press machine.

SUMMARY OF THE INVENTION

A first aspect of the present invention is a die cushion apparatus having a cushion pad, a servomotor for driving to raise or lower the cushion pad while applying an upward energizing force, and a support unit for transmitting a power of the servomotor to the cushion pad and supporting the cushion pad from below, comprising: a hydraulic chamber filled with liquid and located between the cushion pad and the support unit and on a coaxial center of the support unit.

The cushion pad is supported by a rod (support unit) from below. This rod is coupled to the servomotor. A rotary operation of a rotary shaft of the servomotor is converted to an operation of a raising or lowering direction by a ball screw, etc., and transmitted to the rod. Thus, the servomotor applies the upward energizing force to the cushion pad, and drives to raise or lower the cushion pad.

A cylinder is formed in a lower portion of the cushion pad, and a piston coupled to an upper end of the rod is slidably contained in the cylinder. An oil pressure chamber (hydraulic chamber) is formed of an inner wall surface of the cylinder and a wall surface of the piston. The axial center of this oil pressure chamber is the same as the coaxial center of the rod. The pressure oil is filled as a liquid for alleviating the impact is filled in the oil pressure chamber.

The pressure oil filled in the oil pressure chamber absorbs a force operating instantaneously at the cushion pad. Therefore, an instantaneous load received by the cushion pad from the slide is alleviated when the upper die is contacted with the work. Thus, the impact generated in the press machine is alleviated.

A second aspect of the present invention in the first aspect, further comprises an exhaust unit for exhausting the liquid from the hydraulic pressure when the liquid becomes a predetermined pressure or higher.

A pressure oil port of the oil pressure chamber communicates with one port of a control valve (exhaust unit). The other port of the control valve communicates with a tank. If the oil pressure becomes a predetermined pressure or higher, the control valve is opened, and the pressure oil is exhausted to the tank. Then, the press machine is stopped.

A third aspect of the present invention in the first aspect, further comprises: a pressure sensor for measuring a pressure of the liquid, and a control unit for controlling an operation of the servomotor by using a measured value of the pressure sensor.

The oil pressure of the oil pressure chamber is measured by the pressure sensor. The measured value of the pressure sensor is outputted to a pad controller (control unit). A cushion pressure of the cushion pad is set previously in the pad controller. The pad controller feedback controls an operation of the servomotor by using this set cushion pressure and the inputted measured value of the pressure sensor.

According to the first aspect of the invention, since the instantaneous load operating at the cushion pad is absorbed by the pressure oil and alleviated, the impact generated in the press machine is alleviated. Therefore, the wear of the mold can be reduced, and a cost rise can be suppressed. Further, an impact sound can be reduced, and a noise problem can be obviated.

According to the second aspect of the invention, if the oil pressure becomes a predetermined pressure or higher, since the pressure oil is exhausted from the oil pressure chamber and the press machine is stopped, a damage of the die cushion due to an overload can be prevented.

According to the third aspect of the invention, since a pressure feedback control is performed by using the oil pressure received by the load of the cushion pad, the cushion pressure of the cushion pad can be controlled in high accuracy. Therefore, workability of the press can be improved.

DETAILED DESCRIPTION OF THE INVENTION

Embodiments of the present invention will be described in detail with reference to the accompanying drawings.

Figure 1:
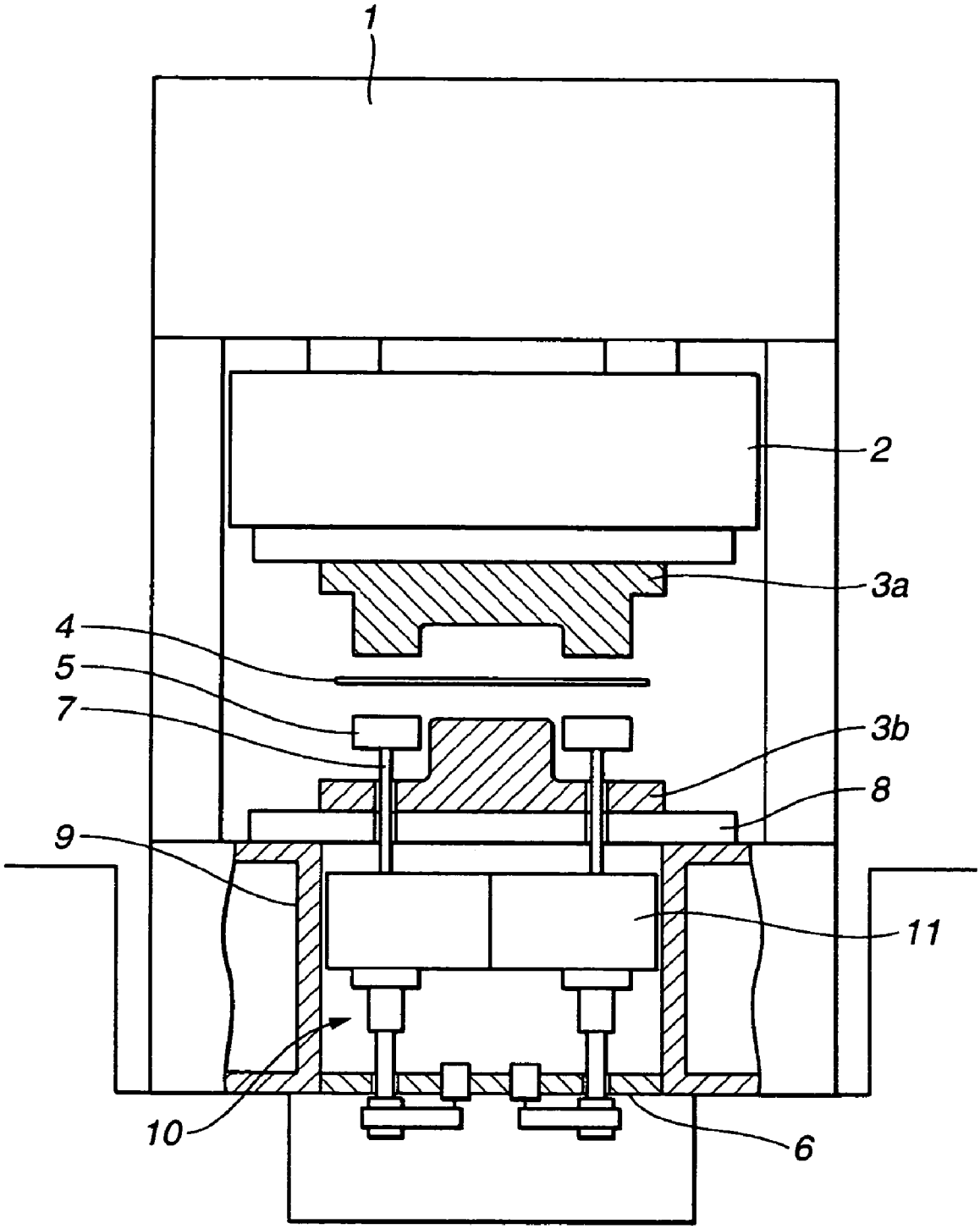
FIG. 1 is a schematic view showing a structure of a press machine.

FIG. 1 is a schematic view showing a structure of a press machine of the present invention.

In the press machine, a slide 2 disposed at an upper portion and a bolster 8 disposed in a lower portion are provided oppositely to each other. The slide 2 receives a power from an upper slide drive mechanism 1 and operates to be raised or lowered. An upper die 3*a* is mounted in the lower part of the slide 2. On the other hand, the bolster 8 is fixed to an upper portion of a bed 9, and a lower mold 3*b* is mounted in an upper portion of the bolster 8. A plurality of holes which penetrate in a vertical direction are provided in the bolster 8 and the lower mold 3*b*, and cushion pins 7 are respectively inserted into these holes. An upper end of the cushion pin 7 is contacted with a lower portion of a blank holder 5 provided in a recess portion of the lower mold 3*b*, and a lower end of the cushion pin 7 is contacted with the cushion pad 11 of the die cushion 10 provided in the bed 9. A beam 6 is provided between the inner wall surfaces of the bed 9, and the die cushion 10 is supported by the beam 6.

Embodiment 1

Figure 2:
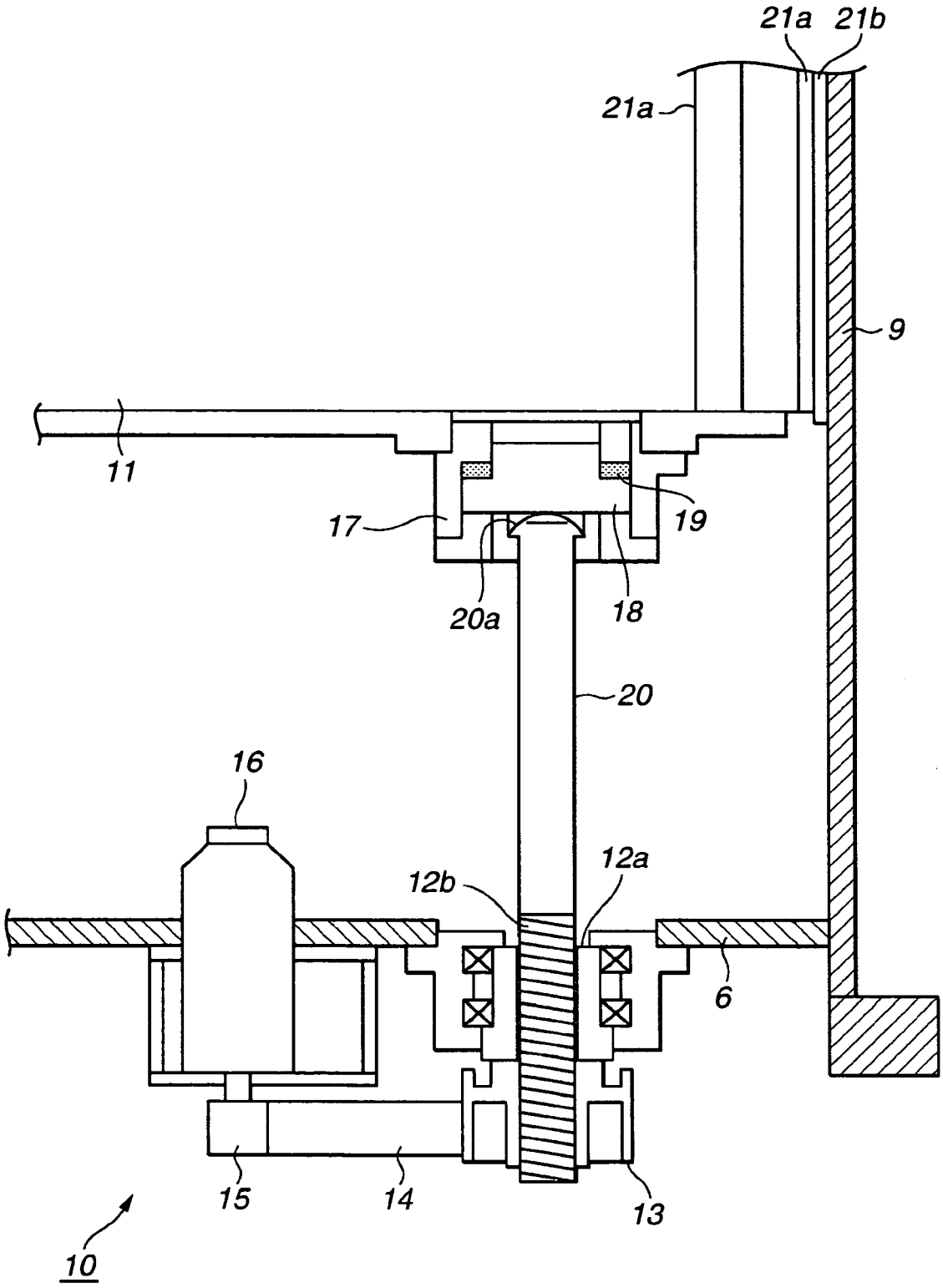
FIG. 2 is a schematic view of a die cushion according to a first embodiment.
Figure 3:
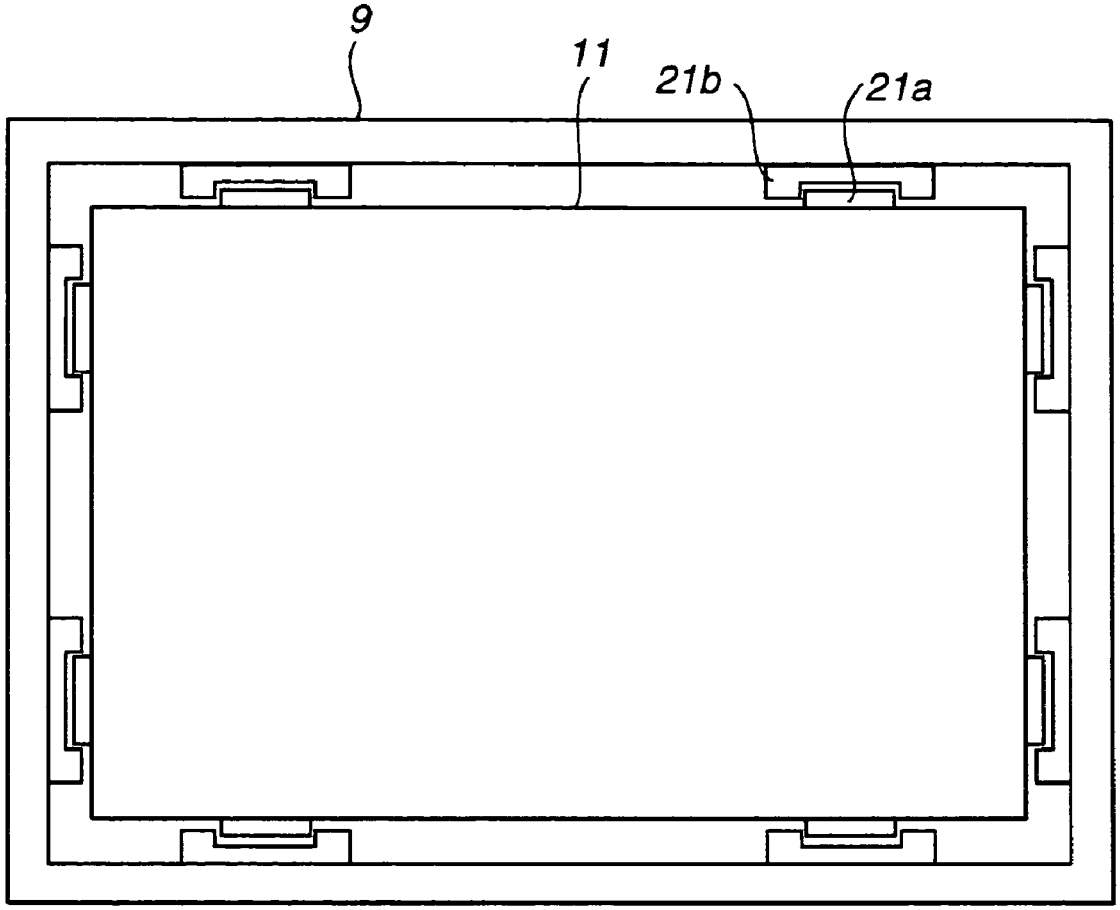
FIG. 3 is a top view of the die cushion according to first embodiment.

FIG. 2 is a schematic view of the die cushion according to the first embodiment. FIG. 3 is a top view of the die cushion according to the first embodiment.

In the die cushion 10, the cushion pad 11 is coupled to a rotary shaft of the servomotor 16 through a cylinder 17, a piston 18, a rod 20, a ball screw 12, a large pulley 13, a belt 14 and a small pulley 15. A power can be transmitted to each other between the cushion pad 11 and the servomotor 16.

The cylinder 17 having an opening in a downward direction is formed in the lower portion of the cushion pad 11, and the piston 18 is slidably contained in the cylinder 17. A recess directed to a bottom, that is, upward is provided in the cylinder 17, and a protrusion is provided at an upper portion of the piston 18. The piston 18 is contained in the cylinder 17. When the protrusion of the piston 18 is engaged within the recess of the cylinder 17, an annular oil pressure chamber 19 is formed of the inner wall surface of the cylinder 17 and the wall surface of the piston 18. The coaxial center of this oil pressure chamber 19 is identical with the coaxial centers of the rod 20 and the ball screw 12. The pressure oil for alleviating the impact is filled in the oil pressure chamber 19. The oil pressure chamber 19 according to this embodiment is sealed, however, it may be configured to have a pressure oil port (not shown) so that supply and discharge of the pressure oil can be carried out freely.

A lower end of the piston 18 is contacted with an upper end of the rod 20. A spherical surface contact surface 20*a* is formed on the upper end of the rod 20. A bar-like member like the rod 20 is strong against an axial force operating at the end portion, but is weak against a bending moment. When the upper end of the rod 20 is a spherical shape, even if the cushion pad 11 is inclined, only the axial force is operated at the rod 20 entirety. A damage of the rod 20 due to a deviated load can be prevented by such a structure.

The lower end of the rod 20 is connected to the upper end of a threaded portion 12*b* of the ball screw 12. The threaded portion 12*b* of the ball screw 12 is engaged with a nut portion 12*a*. The lower end of the nut portion 12*a* is connected to the upper end of the large pulley 13, and supported to the beam 6 by a bearing or the like. The belt 14 is wound on the large pulley 13 and the small pulley 14, and a power can be transmitted to each other.

A rotary type servomotor 16 has a rotary shaft, which is rotated forward or reverse by supplying a current. When the current is supplied to the servomotor 16 and the rotary shaft is rotated, the small pulley 15 and the large pulley 13 are operated to be rotated. Since the large pulley 13 and the nut portion 12*a* are integrated, the nut portion 12*a* is rotated as the large pulley 13 rotates. As the nut portion 12*a* rotates, the threaded portion 12*b* linearly moves along a vertical direction, that is, raising or lowering direction along the nut portion 12*a*. The cushion pad 11 operates to be raised or lowered together with the threaded portion 12*b*, the rod 20, the piston 18, the oil pressure chamber 19 and the cylinder 17. The energizing force applied to the cushion pad 11, that is, the cushion pressure generated at the cushion pad 11 is controlled by the current control to the servomotor 16.

As shown in FIG. 3, one or more guides 21 are provided between the side faces of the cushion pad 11 and the inner wall surfaces of the bed 9 opposed to the respective side faces of the cushion pad 11. The guides 21 have a pair of inner guides 21*a* and outer guides 21*b* engaged with each other, the inner guides 21*a* are provided on the respective side faces of the cushion pad 11 and the outer guides 21*b* are provided on the inner wall surfaces of the bed 9. The guides 21 guide the cushion pad 11 in the raising or lowering direction.

Figure 4:
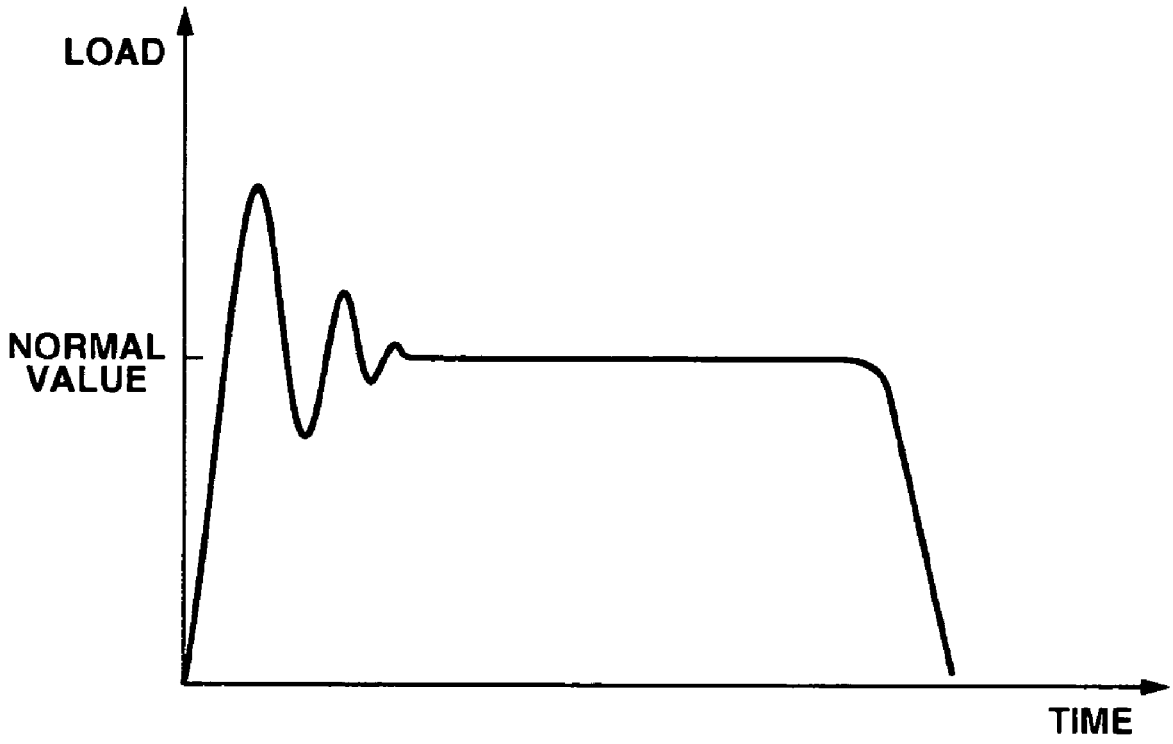
FIG. 4 is a view showing the relationship between a load operating at the cushion pad and a time in this embodiment.

FIG. 4 is a view showing the relationship between a load operating at the cushion pad and a time in this embodiment.

Figure 11:
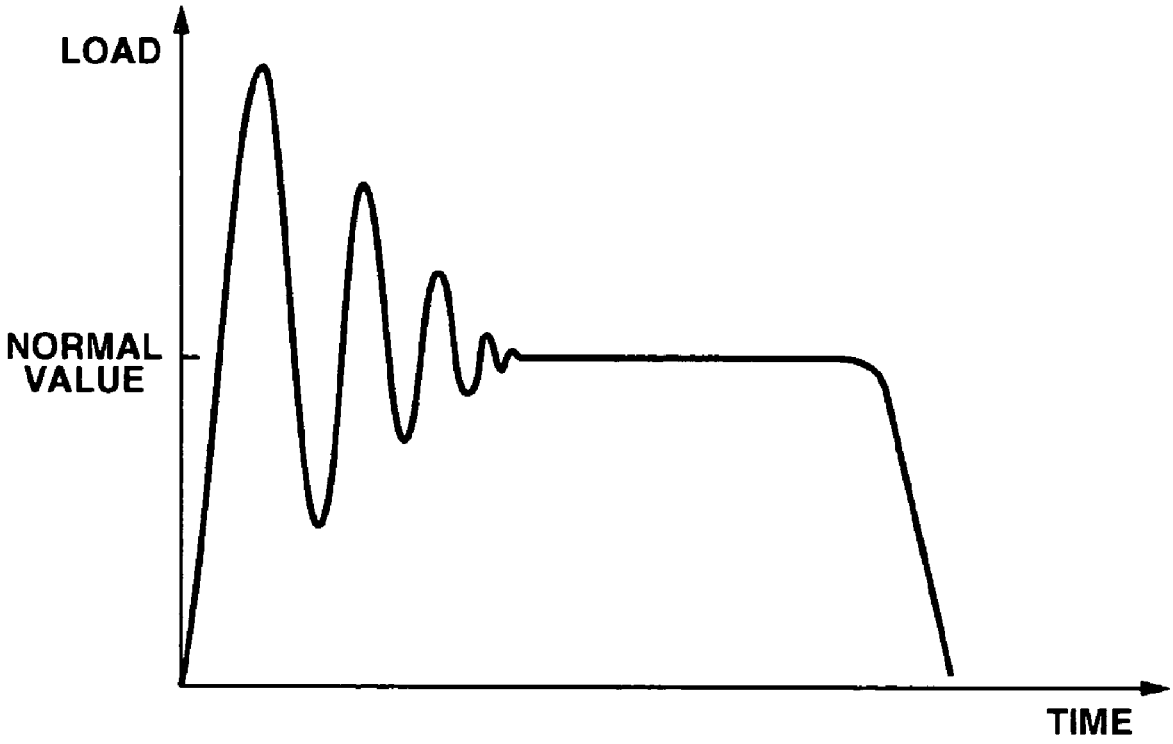
FIG.11 (PRIOR ART)
FIG. 11 is a view showing the relationship between a load acting on the cushion pad and a time in a conventional device.

When FIG. 4 is compared with FIG. 11, it is understood that an amount of overshoot of the load operating at the cushion pad 11 of this embodiment is smaller than that of the conventional apparatus. The pressure oil filled in the oil pressure chamber 19 absorbs a force operating instantaneously at the cushion pad 11. Therefore, as shown in FIG. 4, the instantaneous load received from the slide 2 by the cushion pad 11 when the upper die is contacted with the work is alleviated. Therefore, the impact generated in the press machine is alleviated.

According to the first embodiment, since the instantaneous load operating at the cushion pad is absorbed to the pressure oil and alleviated, the impact generated in the press machine is alleviated. Therefore, the wear of the mold can be reduced, and a cost rise can be suppressed. Further, the impact sound can be reduced, and a noise problem can be eliminated.

Embodiment 2

Figure 6:
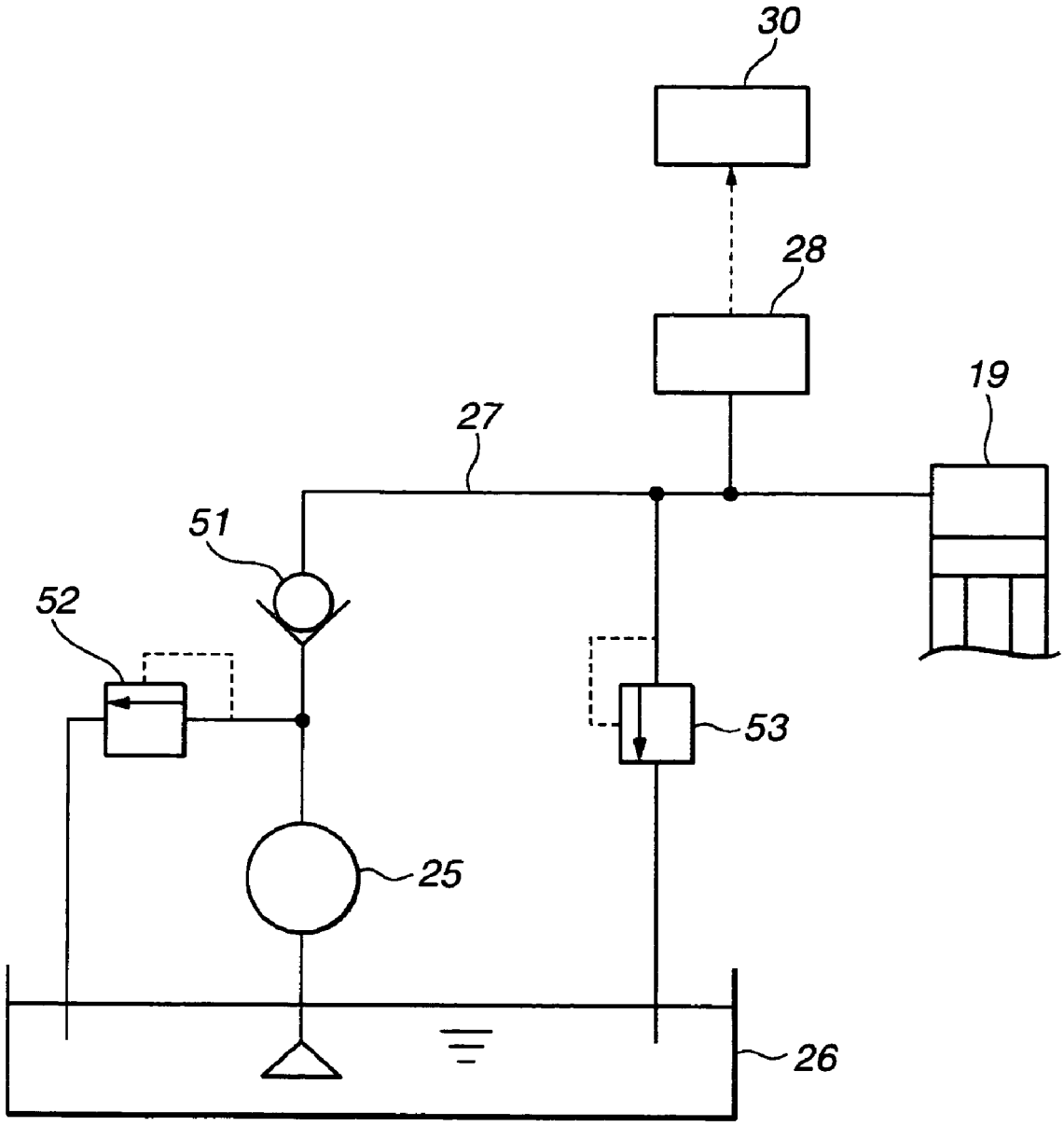
FIG. 6 is an oil pressure circuit diagram according to the second embodiment.

In the first embodiment, the oil pressure circuit as shown in FIG. 6 may be connected to the oil pressure chamber 19. Its embodiment will be described as a second embodiment.

Figure 5:
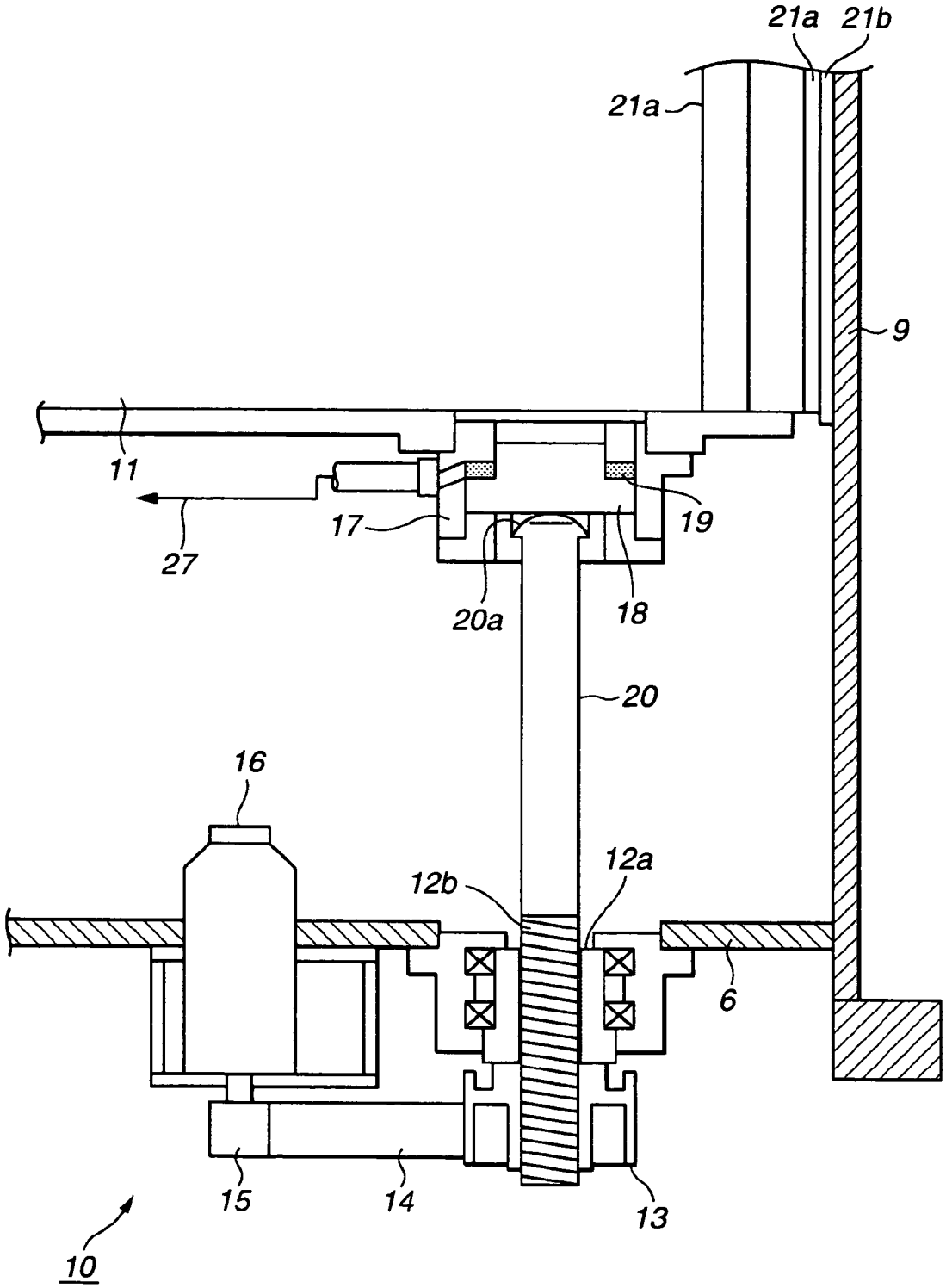
FIG. 5 is a schematic view of a die cushion according to a second embodiment.

FIG. 5 is a schematic view of a die cushion according to the second embodiment. FIG. 6 is an oil pressure circuit diagram according to the second embodiment.

A pressure oil discharge port of an oil pressure pump 25 communicates with a pressure oil port of an oil pressure chamber 19 through a check valve 51 and a conduit 27. A branch conduit is connected to a conduit between the oil pressure pump 25 and the check valve 51, and this branch conduit communicates with a relief valve 52. Furthermore, the relief valve 52 communicates with the tank 26. The pressure oil discharged from the oil pressure pump 25 is set to a predetermined pressure, and the residual pressure oil is returned to the tank 26. Incidentally, it is provided that a pressure change in the oil pressure chamber 19 may not affect an influence directly to the oil pressure pump 25 by the check valve 51.

A branch conduit is connected to the conduit 27, and this branch conduit communicates with a relief valve 53. Also, the relief valve 53 communicates with the tank 26. In the relief valve 53, the maximum oil pressure for preventing the overloaded is set as a relief pressure. When the oil pressure in the oil pressure chamber 19 reaches the maximum oil pressure, the relief valve 53 opens, and the pressure oil in the conduit 27 is returned to the tank 26 through the relief valve 53. Then, the oil pressure in the oil pressure chamber 19 drops. When the measured value of a pressure sensor 28 becomes a predetermined pressure or lower, a controller, not shown, emergency stops a press machine. Therefore, the pressure oil in the conduit 27 is exhausted, thereby preventing overloading.

Figure 9:
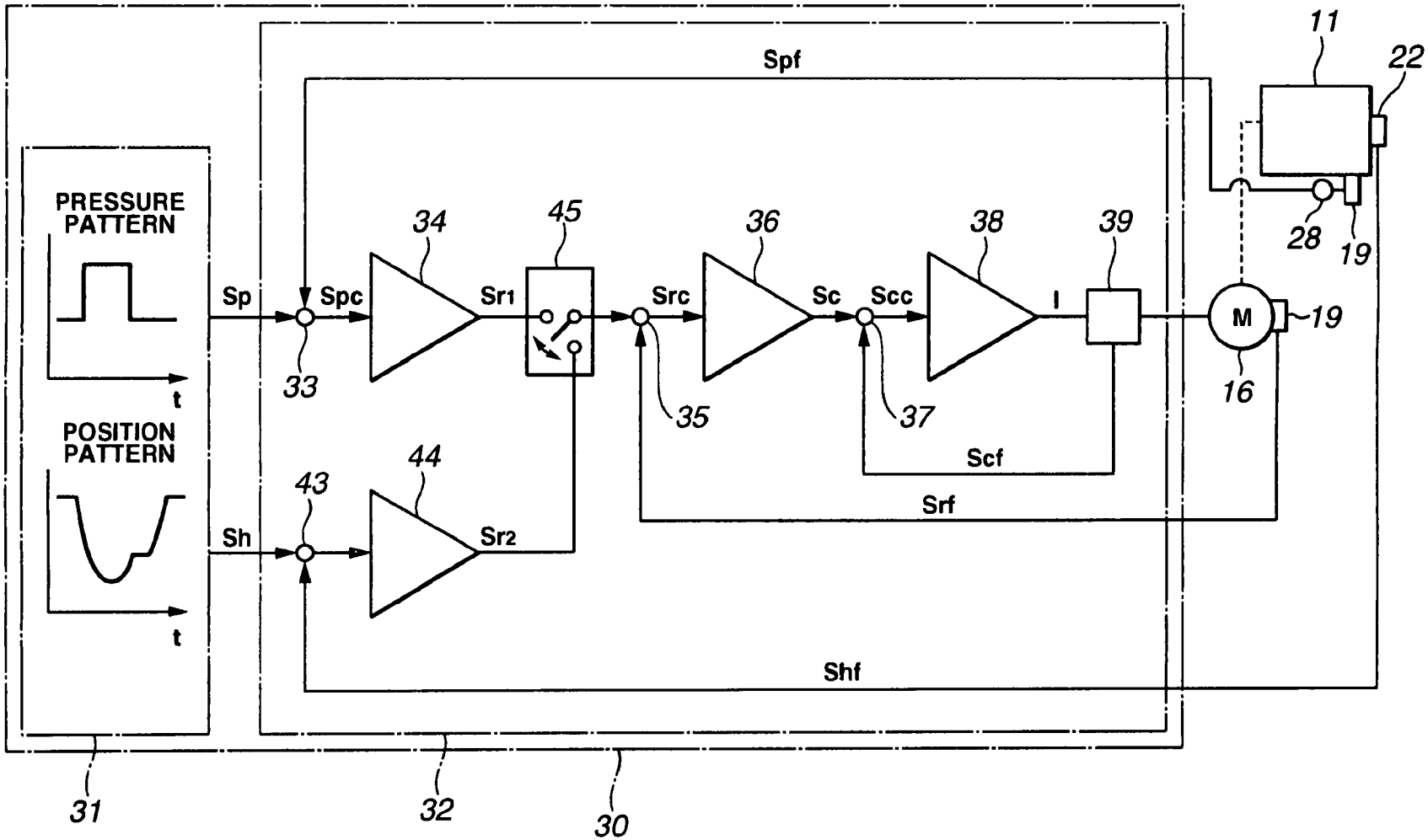
FIG. 9 is a control block diagram of feedback control performed in the second embodiment.

The pressure sensor 28 is provided at the conduit 27. The pressure of the oil pressure chamber 19, that is a load generated at the cushion pad 11 is measured by the pressure sensor 28. The measured value of the pressure sensor 28 is outputted to a pad controller 30. And, a feedback control shown in a control block diagram of FIG. 9 is performed. The detail of the feedback control will be described later.

Figure 7:
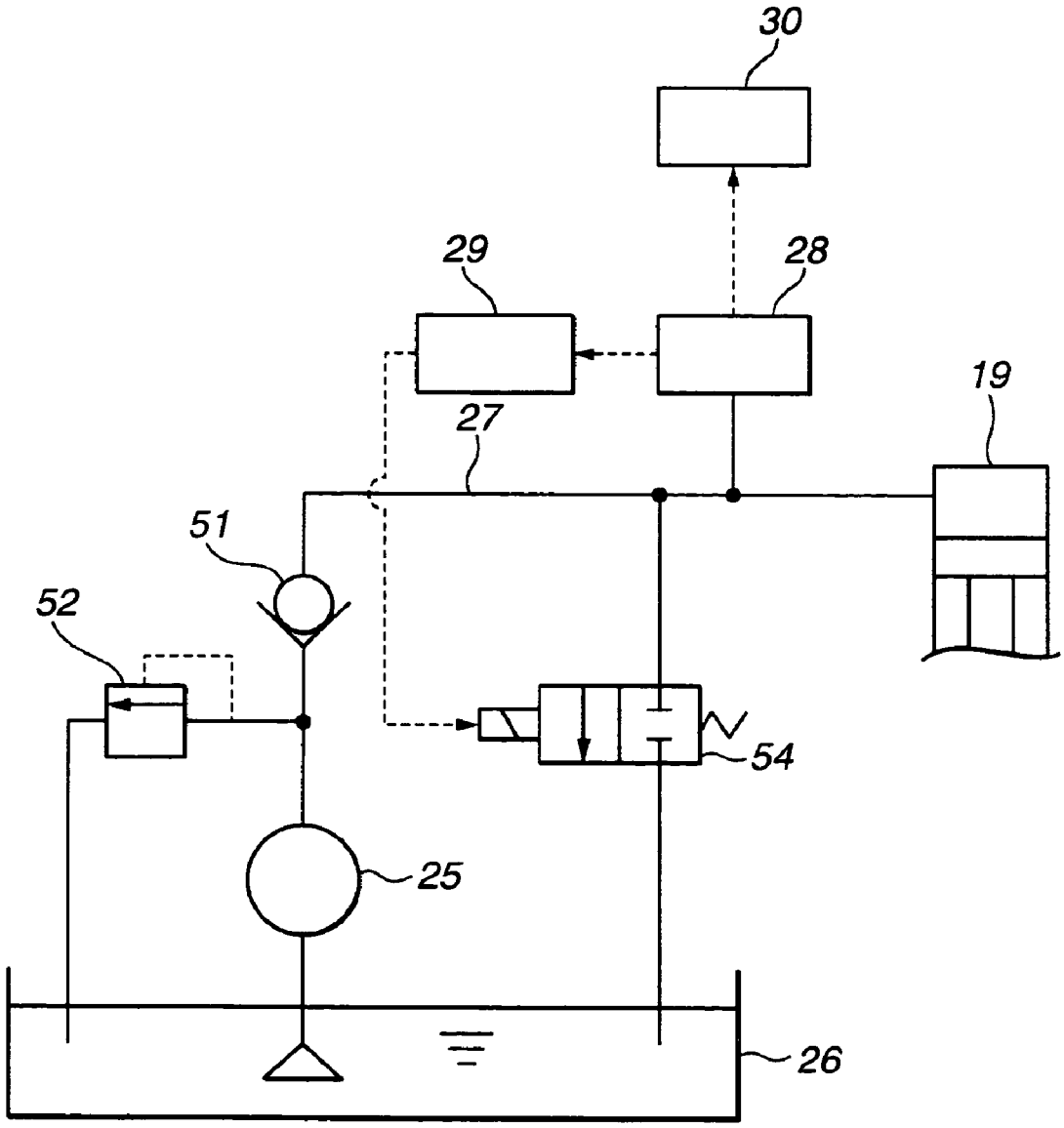
FIG. 7 is an oil pressure circuit diagram according to another form of the second embodiment.

FIG. 7 is an oil pressure circuit diagram according to another form of the second embodiment.

As shown in FIG. 7, a directional control valve 54 may be provided instead of the relief valve 53 of FIG. 6. Normally, the directional control valve 54 presses a spool, a poppet, etc. provided in itself by a spring force to shut off the conduit 27 and the tank 26. If the measured value of the pressure sensor 28 exceeds a predetermined pressure, there is possibility of overloading. The measured value of the pressure sensor 28 is outputted to a pressure controller 29. If the measured value exceeds the predetermined pressure, the pressure controller 29 outputs a relief signal to the direction control valve 54. The direction control valve 54, to which the relief signal is inputted, excites a coil provided in itself. When a propulsion force by a magnetic force exceeds a pressing force by the spring force, the spool, the poppet, etc. will move. Thus, the directional control valve 54 is switched, and the conduit 27 communicates with the tank 26. Then, the pressure oil in the conduit 27 is returned to the tank 26 through the directional control valve 54. The pressure controller 28 outputs an emergency stop signal together with the relief signal to the controller of the press machine, not shown. The controller emergency stops the press machine in response to the input of the emergency stop signal. Thus, the overloading is prevented.

Figure 8:
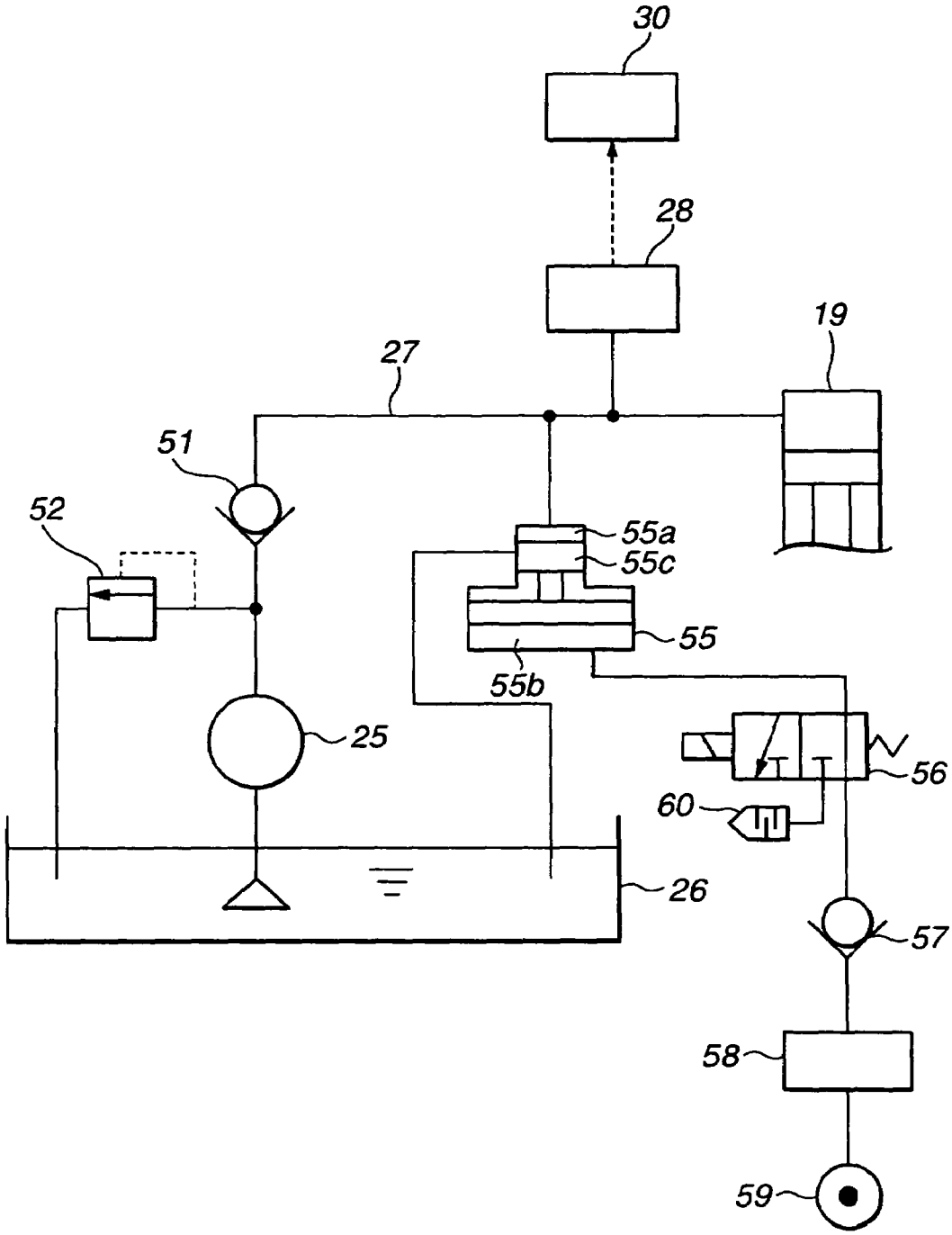
FIG. 8 is an oil pressure circuit diagram according to another form of the second embodiment.

FIG. 8 is an oil pressure circuit diagram according to another form of the second embodiment.

As shown in FIG. 8, a protector valve 55 may be provided instead of the relief valve 53 of FIG. 6. The protector valve 55 includes an oil chamber 55*a* of small diameter and an air chamber 55*b* of large diameter, and further includes a piston 55*c* comprised of a small diameter piston slidable in the oil chamber 55*a* and a large diameter piston slidable in the air chamber 55*b*. The conduit 27 communicates with the oil chamber 55*a*. The air chamber 55*b* communicates with an air pressure source 59 through a directional control valve 56, a check valve 57 and a pressure regulator 58. An oil pressure port is provided at the side face of the oil chamber 55*a*. The oil pressure port communicates with the tank 26.

When the oil pressure in the conduit 27 is the maximum oil pressure for preventing the overloading, the air pressure in the air chamber 55*b* is set by the pressure regulator 58 to balance the piston 55*c*. That is, when the oil pressure in the conduit 27 becomes the maximum oil pressure or higher, the piston 55*c* moves to the air chamber 55*b* side. The conduit 27 communicates with the tank 26 by the movement of the piston 55*c*. Then, the pressure oil in the conduit 27 is returned to the tank 26 through the protector valve 55. When the piston 55*c* is moved to the air chamber 55*b* side, a proximity switch detects the movement of the piston 55*c*, and outputs an emergency stop signal to the controller of the press machine, not shown. The controller emergency stops the press machine in response to the input of the emergency stop signal. Thus, the overloading is prevented.

Normally, the directional control valve 56 presses the spool, the poppet, etc. provided in itself by a spring force to bring the tank 26 into communication with the duct 27. When a solenoid in the directional control valve 56 is excited, a propulsion force by the magnetic force is generated at the spool, the poppet, etc. When the propulsion force by the magnetic force exceeds the pressing force by the spring force, the spool, the poppet, etc. move. Thus, the directional control valve 56 is switched, and the air in the air chamber 55*b* is released to the atmosphere through a silencer 60. Then, the oil in the oil chamber 19 is returned to the tank 26. Thus, the operation of the directional control valve 56 is performed mainly at a maintenance time.

Next the feedback control of the die cushion will be described.

FIG. 9 is a control block diagram of the feedback control performed in a second embodiment.

Various type measuring devices are provided in the die cushion 10. A linear scale 22 having a raising or lowering direction as a measuring direction is provided between the cushion pad 11 and the bed 9. A scale section of the linear scale 22 is provided on an inner wall surface of the bed 9, and a head portion is approached to the scale section, and fixed to the cushion pad 11 side. As the cushion pad 11 is raised or lowered, the head section moves along the scale. The raised or lowered position of the cushion pad 11 is measured by this linear scale 22. An encoder 19 is provided around a rotary shaft of the servomotor 16. A rotating speed of the servomotor 16 is measured by this encoder 19. The respective measured values are inputted to the pad controller 30, and the supply current to the servomotor 16 is outputted.

The pad controller 30 has a controller 31 and an amplifier 32. In the controller 31, a pressure pattern showing desired corresponding relationship between a time (or a press angle or a slide position) and a pressure generated at the cushion pad 11, that is, a cushion pressure, and a position pattern showing desired corresponding relationship between a time (or a press angle or a slide position) and a position of the cushion pad 11, are set. In this controller 31, the cushion pressure corresponding to a time (or a press angle or a slide position) is obtained by using the pressure pattern, and outputted as a pressure control signal Sp. Also, a cushion position corresponding to the time (or a press angle or a slide position) is obtained by using the position pattern, and outputted as a position control signal Sh. The pressure control signal Sp, the position control signal Sh and its other measured value are inputted to the amplifier 32. The amplifier 32 performs any of the pressure feedback control or the position feedback control, and both are switched at predetermined timing.

It should be noted that the "pressure" of the pressure pattern includes a load applied to the cushion pad 11 and a strain occurred in a member of the cushion pad 11. Because the load and the strain are correlated with each other. In the case where the oil pressure chamber 19 is provided, as in the present invention, the oil pressure in the oil pressure chamber 19 may be used as the "pressure".

Here, the feedback control performed in the pad controller 30 will be explained first with respect to the pressure feedback control.

The pressure generated at the cushion pad 11, that is the cushion pressure is measured by the pressure sensor 28, and its value is outputted as a pressure feedback signal Spf to a pressure comparator 33. The pressure comparator 33 compares the value of the pressure feedback signal Spf with the value of the pressure control signal Sp, and a pressure correction signal Spc is generated. The pressure correction signal Spc is outputted to the pressure controller 30. The pressure controller 30 obtains a suitable speed of the servomotor 16 based on the pressure correction signal Spc, and generates a motor speed control signal Sr1. The motor speed control signal Sr1 is outputted to a speed comparator 35.

A rotary speed of the servomotor 16 is measured by the encoder 19, and its value is outputted as a speed feedback signal Srf to the speed comparator 35. The speed comparator 35 compares the value of the motor speed control signal Sr1 (Sr2 in the case of the position feedback control) with the value of the speed feedback signal Srf, and generates a motor speed correction signal Src. The motor speed correction signal Src is outputted to a speed controller 36. The speed controller 36 obtains a suitable current value to the servomotor 16 based on the motor speed correction signal Src, and generates a current control signal Sc. The current control signal Sc is outputted to a current comparator 37.

The supply current to the servomotor 16 is measured by a current detector 39, and its value is outputted to the current comparator 37 as a current feedback signal Scf. The current comparator 37 compares the value of the current control signal Sc with the value of the current feedback signal Scf, and generates a current correction signal Scc. The current correction signal Scc is outputted to a current controller 38. The current controller 38 generates a suitable supply current I to the servomotor 16 based on the current correction signal Scc. The supply current I is outputted to a current detector 39, and supplied to the servomotor 16. Then, the servomotor 16 drives the cushion pad 11. In this case, the cushion pad 11 is lowered while generating an upward energizing force. The thus set cushion pressure is obtained.

Then, the position feedback control will be described.

A height position of the cushion pad 11 is measured by the head section of the linear scale 22, and its value is outputted as a position feedback signal Shf to a position comparator 43. The position comparator 43 compares the value of the position feedback signal Shf with the value of the position control signal Sh, and generates a position correction signal Shc. The position correction signal Shc is outputted to a position controller 44. The position controller 44 obtains a suitable speed of the servomotor 16 based on the position correction signal Shc, and generates a motor speed control signal Sr2. The motor speed control signal Sr2 is outputted to the speed comparator 35. A flow of the signal after the speed comparator 35 is the same as the pressure feedback control.

Incidentally, in the pad controller 30, functions up to the speed controller 36 are incorporated in the controller 31 side, and functions after the current comparator 37 may be incorporated in the amplifier 32 side.

The pressure feedback control and the position feedback control are switched by a switching operation of a switching unit 45. In this embodiment, when a first switching time when the upper die is contacted with the work is detected, the position feedback control is switched to the pressure feedback control, and when a second switching time when the cushion pad 11 reaches a bottom dead point is detected, the pressure feedback control is switched to the position feedback control.

The first switching time is at the time when a measured value of a strain gage 17 reaches a first threshold value at the cushion pad 11 lowering time (the upper die is contacted with the work so that the pressure of the cushion pad 11 starts generating) or at the time when the measured value of the head section of the linear scale 22 reaches the first predetermined value (the cushion pad 11 reaches the position where the upper die is contacted with the work). The second switching time is at the time when the measured value of the strain gage 17 reaches a second threshold value (when the upper die is separated from the work so that the pressure of the cushion pad 11 is vanished) or at the time when the measured value of the head section of the linear scale 22 reaches a second predetermined value (when the cushion pad 11 reaches a bottom dead point).

Then, the relationship between the operation of the cushion pad 11 and the pressure and the position feedback control will be described with reference to FIG. 9 and FIG. 10.

Figure 10:
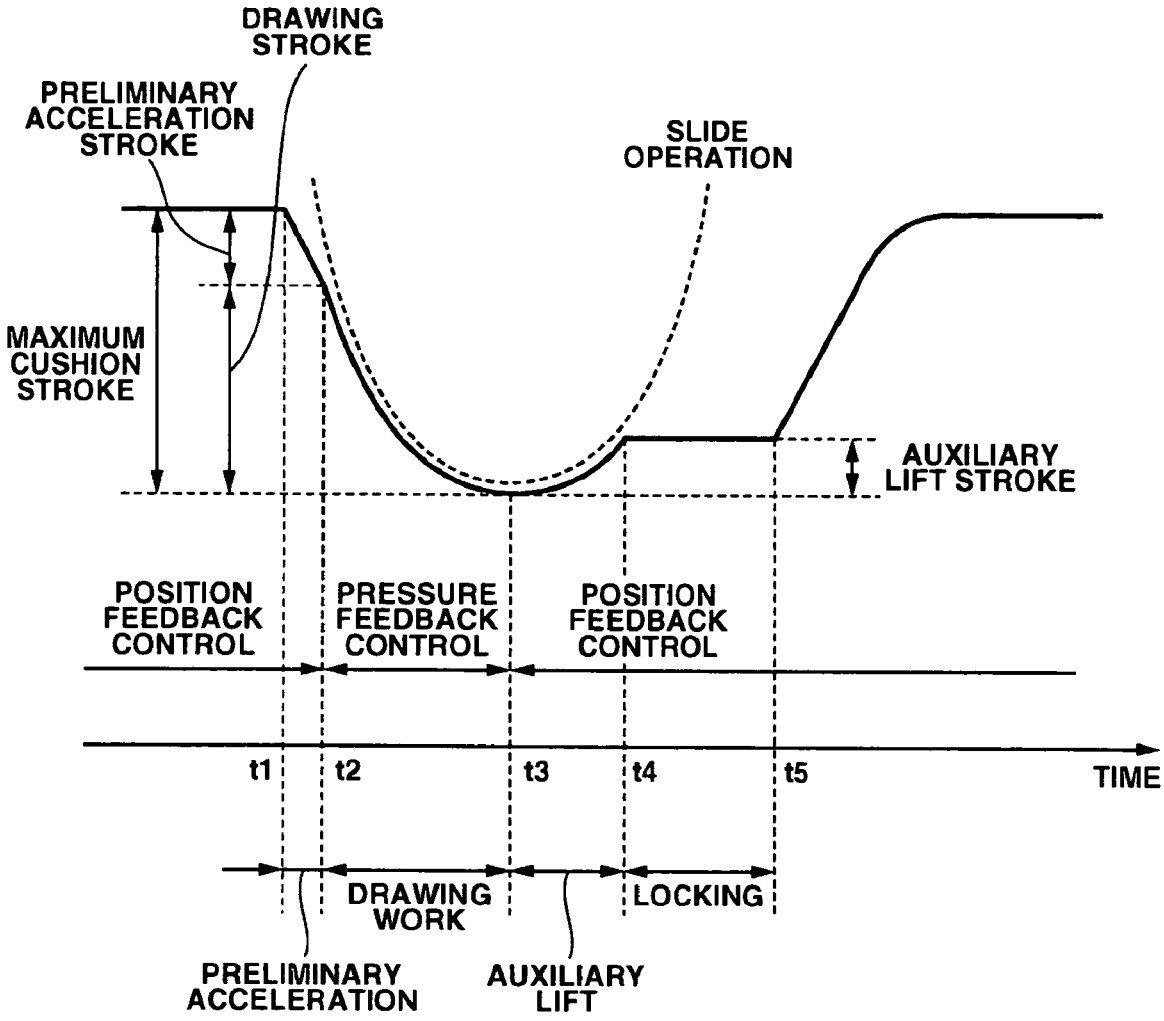
FIG. 10 is a view showing an operation of the slide and the die cushion pad.

FIG. 10 is a view showing the operation of the slide and the die cushion pad, and shows a change of the positions of the slide and the die cushion pad as a time is elapsed.

In the press machine, in order to alleviate the impact when the upper die is contacted with the work, the cushion pad is preliminarily accelerated. The preliminary acceleration is performed from a time t1 to a time t2. During this period, the pad controller 30 performs the position feedback control, and the position of the cushion pad 11 is controlled so that the position measured value follows to the preset position pattern. The cushion pad 11 is lowered in response to its result.

At the time t2 (first switching time), the upper die is contacted with the work. At this time, the switch is switched at the switching unit 4 of the pad controller 30, and the position feedback control is switched to the pressure feedback control. From the time t2 to the time t3, the slide 2 is integrated with the cushion pad 11, lowered together, and the work is drawn. During this period, the pad controller 30 performs the pressure feedback control, and the energizing force applied to the cushion pad 11 is controlled so that the pressure measured value follows to the preset pressure pattern. The cushion pad 11 is lowered in response to its result.

At the time t3 (second switching time), the slide 2 and the cushion pad 11 reach the bottom dead point. At this time, the switch is switched in the switching unit 45 of the pad controller 30, and the pressure feedback control is switched to the position feedback control. During the period from the time t3 to the time t4, the slide 2 is integrated with the cushion pad 11, and only the auxiliary lifting portion is raised. During the period from the time t4 to the time t5, the cushion pad is locked, and once stopped in the raising operation. At the time t5, the cushion pad 11 again starts raising. In the foregoing description, after the time t3, the pad controller 30 performs the position feedback control, and the position of the cushion pad 11 is controlled so that the position measured value follows the preset position pattern. The cushion pad 11 is raised in response to its result.

According to the second embodiment, since the pressure oil is exhausted from the oil pressure chamber and the press machine is stopped when the oil pressure becomes the predetermined pressure or higher, damages of the die cushion due to the overload can be prevented.

Further, according to the second embodiment, since the pressure feedback control is performed with the use of the oil pressure that receives the load of the cushion pad, the cushion pressure of the cushion pad can be controlled in high accuracy. Therefore, the workability of the press can be improved.

What is claimed is:

1. A die cushion apparatus, comprising:

a cushion pad being arranged below and supporting a plurality of cushion pins within a press machine;

a servomotor for raising or lowering the cushion pad while applying an upward energizing force;

a support unit including a rod for transmitting a power of the servomotor to the cushion pad and supporting the cushion pad from below; and a hydraulic chamber filled with liquid being arranged for absorbing an impact operating at the cushion pad, the hydraulic chamber being adjacent the cushion pad and being located and between the cushion pad and the support unit and on a coaxial center of the support unit.

2. The die cushion apparatus according to claim 1, further comprising:

an exhaust unit for exhausting the liquid from the hydraulic chamber when the liquid becomes a predetermined pressure or higher.

3. The die cushion apparatus according to claim 1, wherein:

the hydraulic chamber includes a cylinder, a piston sliding within the cylinder, a rod supporting the piston and being arranged on a coaxial center of the cylinder, the piston rod having a spherical surface contacting the piston, hydraulic chamber being formed between the piston and the cylinder, and a liquid being contained in the hydraulic chamber.

4. The die cushion apparatus according to claim 3, further comprising:

a ball screw being arranged at an end of the rod and communicating with the servomotor for the raising and lowering of the cushion pad.

5. The die cushion apparatus according to claim 1, further comprising:

a pressure sensor measuring a pressure of the liquid, and a control unit for controlling an operation of the servomotor by using a measured value of the pressure sensor.

* * * * *